US006917264B2

(12) United States Patent
DeCormier et al.

(10) Patent No.: US 6,917,264 B2
(45) Date of Patent: Jul. 12, 2005

(54) COAXIAL LINE PHASE STABILIZATION ASSEMBLY AND METHOD

(75) Inventors: William A. DeCormier, Poland, ME (US); Cole N. Plummer, South Casco, ME (US)

(73) Assignee: SPX Corporation, Charlotte, NC (US)

( * ) Notice: Subject to any disclaimer, the term of this patent is extended or adjusted under 35 U.S.C. 154(b) by 150 days.

(21) Appl. No.: 10/329,833

(22) Filed: Dec. 27, 2002

(65) Prior Publication Data

US 2003/0122639 A1 Jul. 3, 2003

Related U.S. Application Data

(63) Continuation-in-part of application No. 09/838,542, filed on Apr. 20, 2001, now Pat. No. 6,703,913.

(51) Int. Cl.[7] ..... H01P 5/00
(52) U.S. Cl. ..... 333/245; 333/263; 333/260
(58) Field of Search ..... 333/245, 260, 333/160, 263

(56) References Cited

U.S. PATENT DOCUMENTS 2,437,067 A * 3/1948 Bingley ..... 333/160

FOREIGN PATENT DOCUMENTS

JP 18201 * 1/1986 ..... 333/260

* cited by examiner

*Primary Examiner*—Benny Lee
(74) *Attorney, Agent, or Firm*—Baker & Hostetler LLP; Jonathan A. Kidney

(57) ABSTRACT

An apparatus and method stabilizes a pair of parallel coaxial lines for an antenna having a tower. An upper portion of each coaxial line is suspended from the tower. A lower end of the coaxial lines is free to move vertically relative to the tower. The apparatus has an expandable element disposed along a first portion of the length of one coaxial line and a frame which rigidly ties together the two coaxial lines at a second portion of each of the lines below the expandable element. One type of expandable element includes telescoping inner conductors and telescoping outer conductors.

13 Claims, 6 Drawing Sheets

COAXIAL LINE PHASE STABILIZATION ASSEMBLY AND METHOD

PRIORITY

This application is a continuation-in-part of U.S. patent application entitled, "COAXIAL LINE PHASE STABILIZATION ASSEMBLY AND METHOD, " filed Apr. 20, 2001, having U.S. patent application Ser. No. 09/838,542, now issued on Mar. 9, 2004, having a U.S. Pat. No. 6,703,913, the disclosure of which is hereby incorporated by reference.

FIELD OF THE INVENTION

The invention relates to an arrangement to stabilize two parallel coaxial lines, such as for example signal lines extending vertically and supported by a transmission tower.

BACKGROUND OF THE INVENTION

It is known in antenna systems to have two parallel coaxial lines extending vertically upwards along the tower. These coaxial lines each include, for example, up to 2,000 feet or more of coaxial tubing in sections, forming a coaxial line fixed to the tower at the top of the line, so that the line is suspended from its top end.

Both coaxial lines may be suspended at points along their length by spring hangers from the tower to allow the coaxial lines to expand and contract with respect to the tower. The spring hangers provide stability while permitting vertical travel of the line relative to the tower due to factors such as thermal expansion of the line relative to the tower. Temperature variations produced by weather and the operating power of the coaxial line cause the coaxial lines to expand at a different rate than the tower. The coaxial line and the tower are also made of different materials, further contributing to differential expansion between the lines and the tower. For example, the coaxial line may be made of copper and the tower made of steel. Since these two metals have different coefficients of expansion, there is a differential in the thermal growth of the copper coaxial line with respect to the steel tower as temperature and power changes.

For this reason, it is known to suspend the coaxial lines from the top of the tower, so they are fixed both vertically and horizontally at the top of the coaxial line to the tower, but are essentially hanging in a suspended state from the top, with the lines being horizontally restrained by spring hangers that permit vertical movement along the length of the line. This permits the length of the line to have vertical travel, and the lower end of the coaxial lines, which usually terminate in an elbow connecting to a horizontal coaxial line section, are free to travel vertically relative to the tower.

A disadvantage of the known arrangement is that one of the two parallel coaxial lines may expand at a different rate than the adjacent coaxial line. For example, if one coaxial line is heated by the sun and the other coaxial line is in the shade, the first coaxial line will expand at a different rate than the second coaxial line. The differential in the relative linear expansion between two adjacent coaxial lines can cause a phase difference in the transmission of signals transmitted through the lines, which can result in undesirable beam tilt when the signal reaches the antenna. That is, if the two coaxial lines expand by different degrees along their length, the distance from the lower elbow to the fixed top portion of the line for each line will be a different total distance. Therefore, if one line elongates more than the other adjacent line, the effective and actual transmission length of the two lines will be different. Because these two lines are intended to carry signals that are at a fixed relative phase at the elbows in the lower portion of the lines, the change in length is undesirable because the signals at the top of the coaxial lines will become out of phase due to their having traveled a different distance.

Accordingly, there is a need for an arrangement that can tie together a pair of parallel coaxial lines and accommodate for differential expansion between sections of the adjacent lines while maintaining a constant relative total length between two points of the lines, such as for example, between a lower elbow and a fixed top end of each line.

SUMMARY OF THE INVENTION

It is therefore a feature and advantage of the present invention to provide an arrangement that can tie together a pair of parallel coaxial lines and accommodate for differential expansion between sections of the adjacent lines while maintaining a constant relative total length between two points of the lines, such as for example, between a lower elbow and a fixed top end of each line.

The above and other features and advantages are achieved through the use of a novel apparatus as herein disclosed. In accordance with one embodiment of the present invention, an apparatus is provided for stabilizing a pair of coaxial lines in an antenna having a tower, with an upper portion of each coaxial line being suspended from the tower, and a lower end of the coaxial lines free to move vertically relative to the tower. The apparatus has expanding means disposed along the first portion of one coaxial line, and tying means for rigidly tying together the two coaxial lines at a second portion of each of the lines below the expansion means.

In another aspect, the invention provides an apparatus as described above, where the portions of the lines which are tied together are elbows.

In yet another aspect of the invention, an apparatus is provided where the frame ties together the portions of the coaxial lines so that they are retained in a common horizontal plane.

In yet another aspect of the invention, the frame includes a cross member that is strapped to each of the second portions of the lines.

In still another aspect of the invention, an apparatus is provided where the frame further includes a stabilization assembly that surrounds the first coaxial line at a position above the flexible section and permits vertical travel of the coaxial line relative to the frame at the surrounded position, and inhibits lateral movement of the coaxial line at that position relative to the frame, thereby permitting the expandable element to expand and contract vertically, and inhibiting axial misalignment of the line above and below the flexible section.

In accordance with another embodiment of the present invention, a method is provided for stabilizing a pair of parallel coaxial lines in a tower. An upper portion of each coaxial line is suspended from the tower, and a lower end of the coaxial lines is free to move vertically relative to the tower. The method comprises the steps of providing an expandable element at a location between the upper portion and lower end of the coaxial line and holding the lower ends of the coaxial lines together at a relative horizontal height with each other.

In another aspect of the invention, the method includes the steps of permitting the lower ends to move vertically relative to the tower, while simultaneously holding the lower ends at the same height as each other.

In another aspect, an apparatus for connecting two coaxial line components to each other, each having a respective inner conductor and outer conductor is provided. The apparatus has a pair of telescoping inner conductor segments; a pair of telescoping outer conductor segments; and a support that supports the respective inner and outer conductor segments in substantial telescoping alignment with each other.

In yet another aspect, an apparatus for connecting two coaxial line components to each other, each having a respective inner conductor and outer conductor. The apparatus comprises an expandable inner conducting means for conducting energy, an expandable outer conducting means for conducting energy, and a supporting means for suggesting the inner and outer conducting means in substantial parallel longitudinal alignment with each other.

In still another aspect, a method is provided for connecting two coaxial line components to each other, each having a respective inner conductor and outer conductor, the method comprising the steps of permitting telescoping motion between a pair of telescoping inner conductors and permitting telescoping motion between a pair of telescoping outer conductors.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract included below, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENTS OF THE INVENTION

In general, according to the invention, two parallel coaxial lines are rigidly suspended from a position such as the top of an antenna tower. The coaxial lines each have an elbow at their base, leading to a horizontal coaxial line section. To permit for differential relative expansion between the coaxial lines, an expandable element is provided between the upper fixed end of one of the coaxial lines and its corresponding lower elbow. The expandable element can expand and contract to accommodate relative differences in elongation. The lower elbows are tied together so they remain in the same horizontal location as each other.

Figure 1:
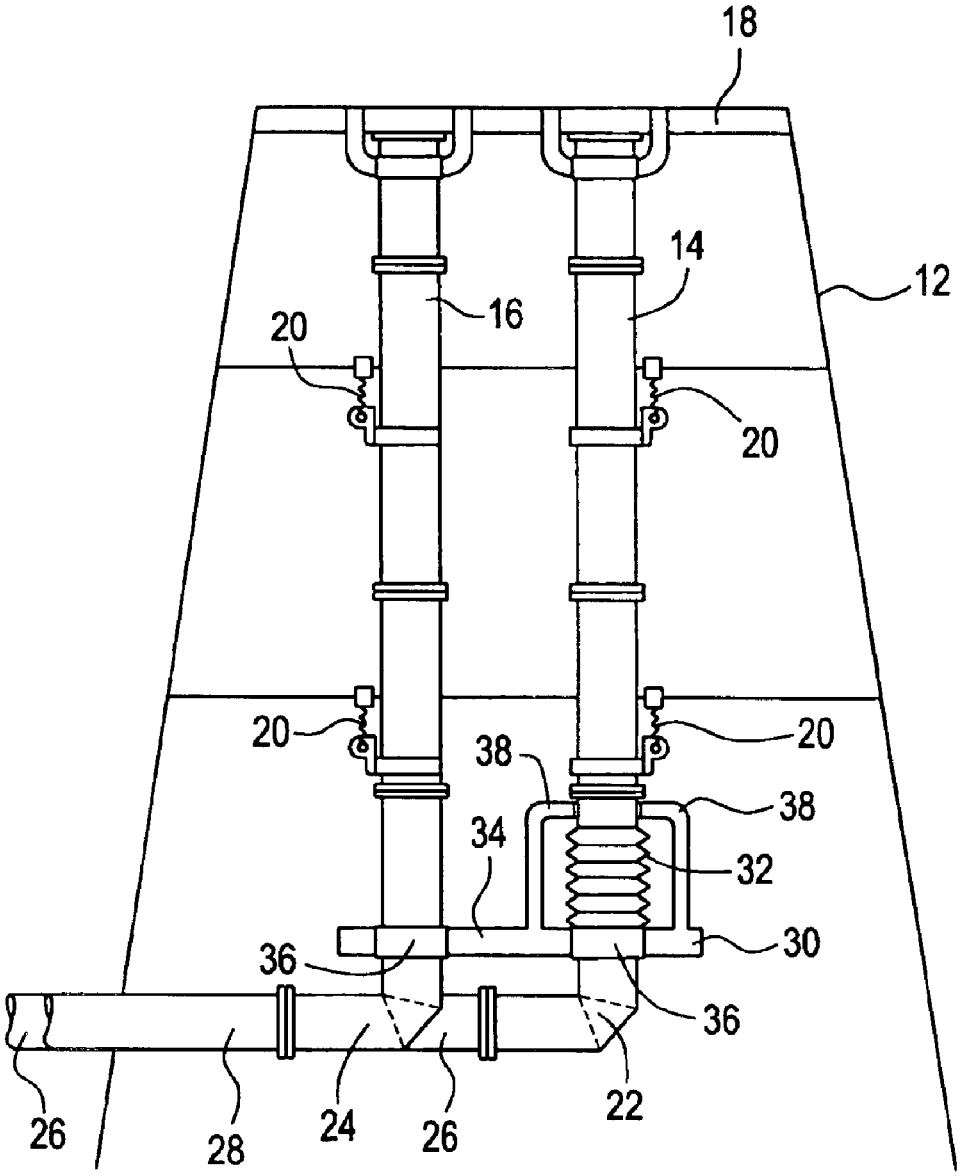
FIG. 1 is a schematic diagram of a tower arrangement having two parallel coaxial lines.

Referring to FIG. 1, a tower 12 is shown with coaxial lines 14 and 16 suspended there from. The coaxial lines 14 and 16 can each be made up of a plurality of sections, each having flanges at their ends and connected end to end by their flanges. The top of each coaxial line 14 and 16 is rigidly connected to a portion 18 of the tower 12. This connection fixes the top sections of the coaxial lines 14 and 16 so that they do not move vertically or horizontally. Along the length of the coaxial lines 14 and 16, they may be attached to portions of the tower by spring hangers 20. These spring hangers 20 permit vertical travel of the coaxial lines 14 and 16 relative to the tower members which the spring hangers are attached to.

The lower parts of the coaxial lines 14 and 16 each terminate in an elbow 22 and 24, respectively. In the embodiment shown, the elbows 22 and 24 are connected to horizontal coaxial line portions 26 and 28.

A frame 30 connects and ties together the vertical portions of the elbows 22 and 24 so that they remain horizontal to each other. Thus, although the frame 30 may move vertically relative to the tower, the two elbows 22 and 24 will travel together, and will always be at the same height or horizontal plane as each other. A flexible section or expandable element 32, which can expand and contract axially, is provided between the upper fixed end of one coaxial line 14 and its corresponding elbow 22.

The length from the top of both coaxial lines 14 and 16, including the flexible section 32, to their respective elbows 22 and 24, is made electrically and mechanically the same length for a given set of ambient conditions. Differences between the expansion of the coaxial lines, such as placement of the sunlight during operation, that cause one coaxial line to grow at a different rate than the adjacent coaxial line are compensated for by compression or expansion of the flexible section.

Thus, the combination of the flexible section 32 and frame 30 provides an advantage of the invention by which differential movement is accommodated, yet the total length of each coaxial line from top to elbow is maintained to be equal relative to each other, so that phase difference and beam tilt can be maintained below or within acceptable levels. Another advantage is that the ability of the lines to expand at a different rate than the tower remains, because the frame is effectively suspended together with the elbows.

In a preferred embodiment, the flexible section is manufactured from stainless steel and plated with high conductivity silver, and has a corrugated sidewall profile. The inner conductor 33, shown in FIG. 2, is manufactured from either stainless steel and plated with high conductivity silver and has a corrugated sidewall profile or utilizes a rigid copper tubing telescoping in another rigid copper tubing with a sliding contact to allow expansion and contraction in the axial direction.

The frame 30 in a preferred embodiment comprises a cross bar portion 34 that is strapped to the upper portions of the elbows 22 and 24 by straps 36. In this way, the elbows 22 and 24 are tied together so that they cannot move vertically relative to each other, and hence the total effective length from the elbows to the top of the coaxial lines 14 and 16 remains constant. If a relative differential expansion is occurring between the segments along the length of coaxial lines 14 and 16, the difference in expansion will be taken up by expansion or contraction of the flexible section 32.

The frame 30 may also include a stabilization leg assembly 38 which extends upward from the frame 30 along the flexible section, without contacting the flexible section, and has a sliding contact with the circumference of the segment of the coaxial line 14 located immediately above the flexible section 32. By virtue of this design, the leg stabilization assembly 38 permits the frame to restrict relative lateral or sideways motion at the flexible section, so that the flexible section provides for only vertical expansion or contraction. In this way, the coaxial line 14 and its elbow 22 remain in axial alignment.

Figure 2:
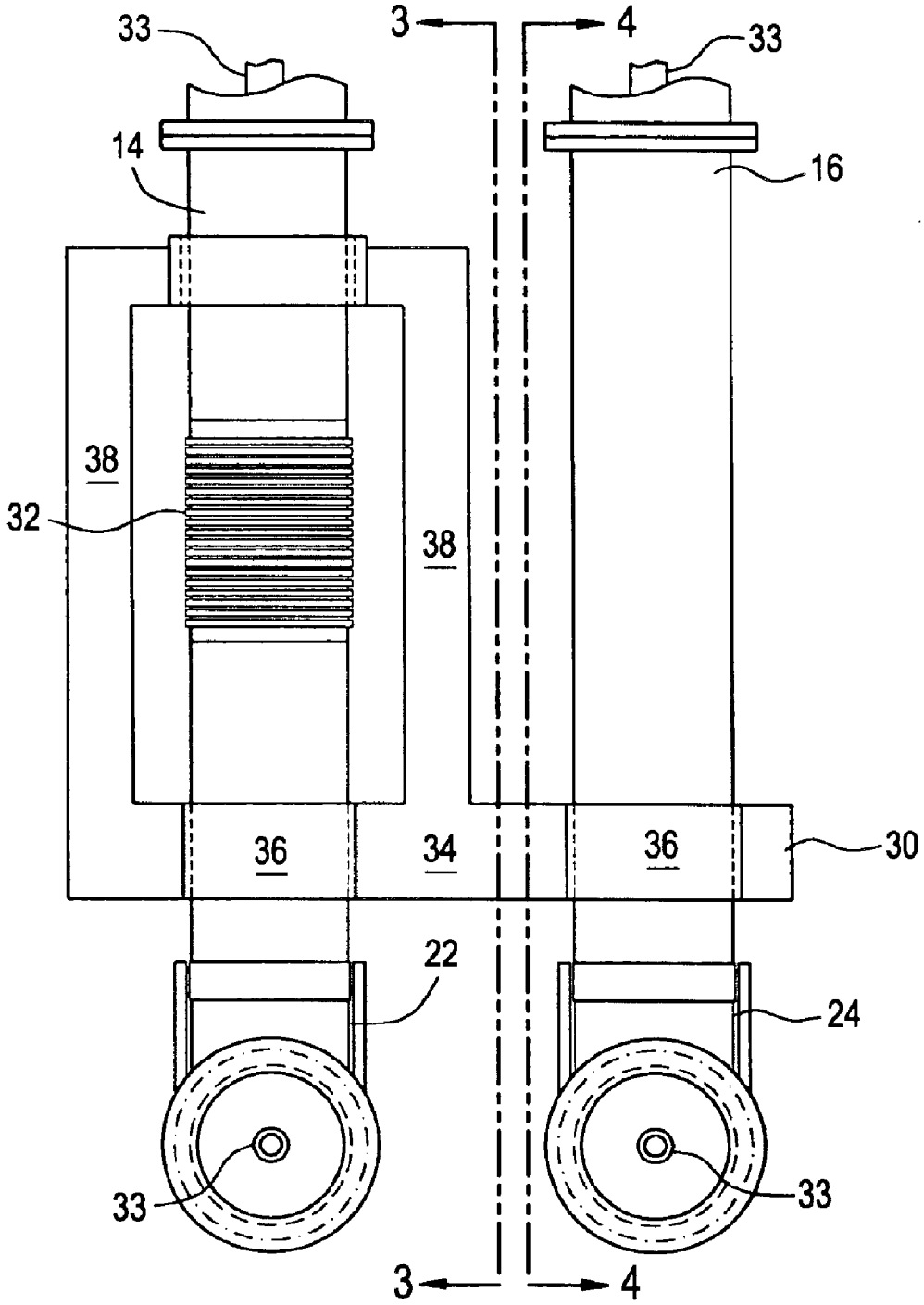
FIG. 2 is a side view of the lower portions of two parallel coaxial lines tied together.
Figure 3:
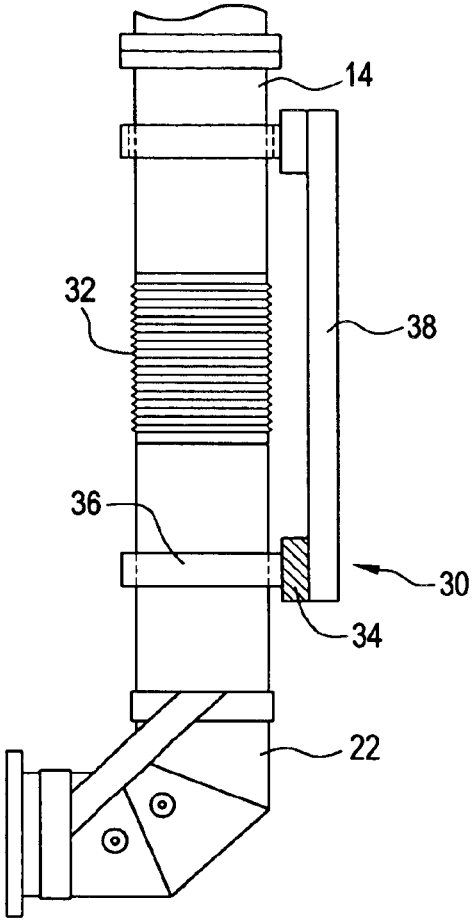
FIG. 3 is a left side view of the coaxial lines of FIG. 2.
Figure 4:
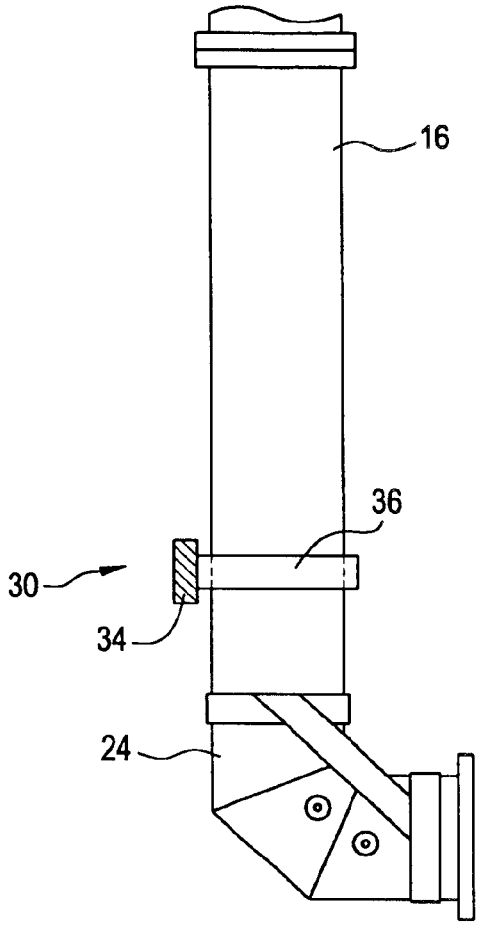
FIG. 4 is a right side view of the coaxial lines of FIG. 2.

FIG. 3 shows the flexible section 32 and the associated coaxial line 14 and elbow 22 viewed from between the two coaxial lines, as indicated by section line 3—3 in FIG. 2. In FIG. 3, as also shown in FIG. 2, the frame 30 has a cross bar portion 34 that is strapped to the upper portion of the elbow 22 by a strap 36. The frame 30 includes a stabilization leg assembly 38 extending upward from the cross bar portion 34 alone the flexible section, without contacting the flexible section. The stabilization leg assembly 38 has a sliding contact with the circumference of the segment of the coaxial line 14 located immediately above the flexible section 32. FIG. 4 shows the coaxial line 16 and elbow 24 viewed from between the two coaxial lines, as indicated by section line 4—4 in FIG. 2. In FIG. 4, as also shown in FIG. 2, the frame 30 has a cross bar portion 34 that is strapped to the upper portion of the elbow 24 by a strap 36.

Although a flexible section is described as the preferred example of an expandable element 32, other suitable expandable devices may be used. For example, the expandable element 32 on the inner and/or outer conductors may alternatively be a rigid copper tubing telescoping in another rigid copper tubing with a sliding contact to allow expansion and contraction in the axial direction.

Although the example described uses one flexible section and one frame, in some examples it is possible to use more than one flexible section and/or more than one frame along the length of a line.

Figure 5:
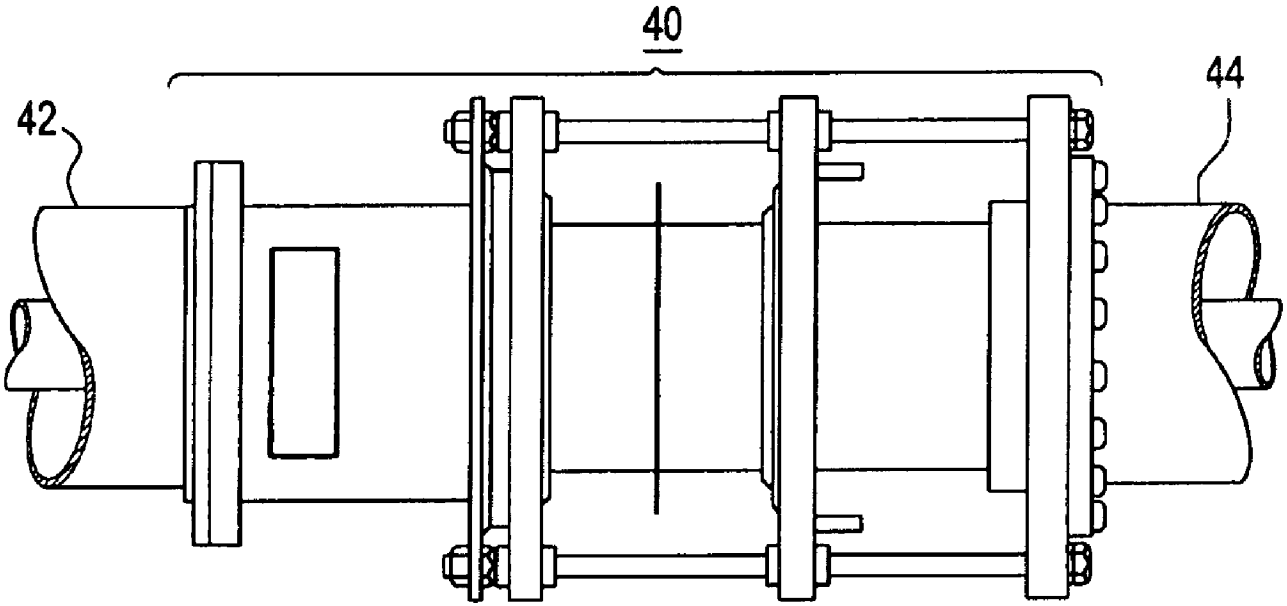
FIG. 5 is a side view of an expandable element for joining the coaxial line sections or components.

FIG. 5 illustrates an alternative embodiment for the flexible section 32, as shown in FIGS. 1, 2, and 3, in the form of an expandable assembly 40, which can expand and contract axially, provided between coaxial parts such as for example the upper fixed end of one coaxial line 42 and another component such as an elbow 44 corresponding to the elbow 22 shown in FIGS. 1, 2, and 3.

Figure 6:
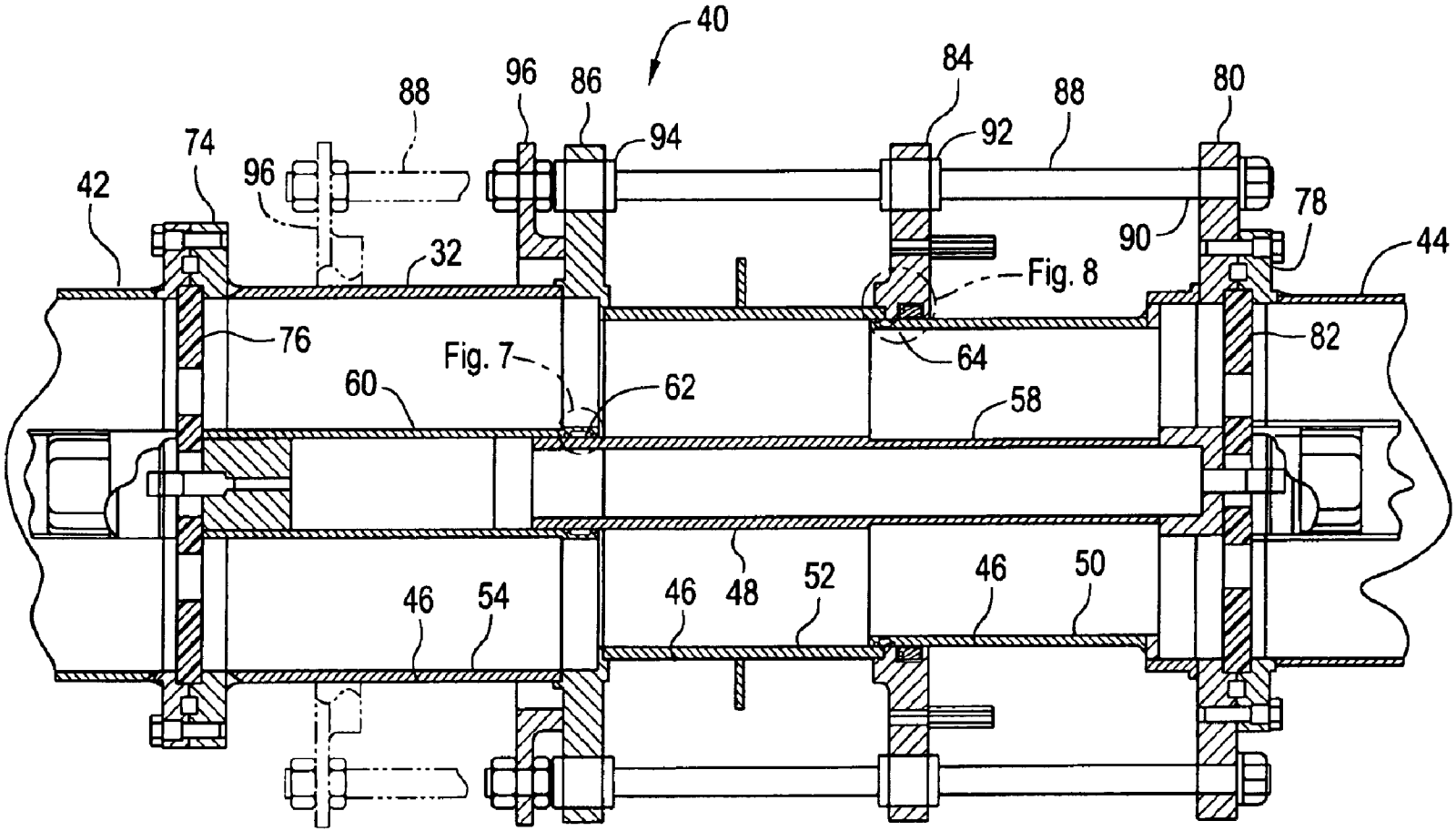
FIG. 6 is a cross sectional view of an expandable element for joining two coaxial line sections or components.
Figure 7:
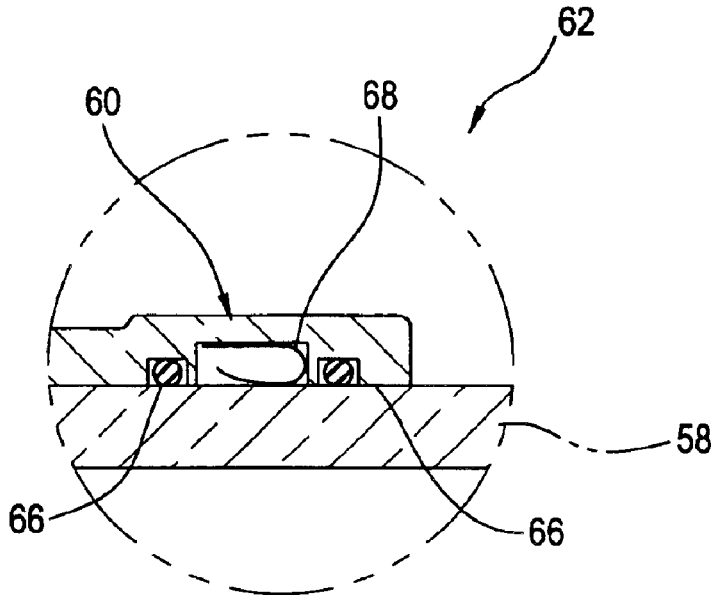
FIG. 7 is a detail view of an area of FIG. 6 so labeled.

As shown in FIG. 6, the sliding contact assembly 62 permits the inner conductor section 58 and inner conductor section 60 of the coaxial line to move slidably relative to one another at the same time as the outer conductor portions 50, 52 of the expandable element 40 also move slidably. Referring now to FIG. 7, a detail view of the sliding contact assembly 62 is illustrated. A pair of o-rings 66 and a spring contact 68 are provided to better ensure contact between the inner conductors 58, 60. The o-rings 66 seal the contact 68 from dirt and resistance that would interfere with conduction.

FIG. 5 illustrates an alternative embodiment for the flexible section 32 in the form of an expandable assembly 40, which can expand and contract axially, provided between coaxial parts such as for example the upper fixed end of one coaxial line 42 and another component such as its corresponding elbow 44.

The preferred embodiment of the expandable assembly 40 is shown in section FIG. 6. As shown in FIG. 6, the outer conductor 46 of the expandable element is manufactured from rigid copper tubing, and has a stair step sidewall profile comprising three outer conductor sections 50, 52, and 54. The inner conductor 48 utilizes a first rigid copper tubing section 58 telescoping in a second rigid copper tubing 60 with a sliding contact arrangement 62, shown in detail FIG. 7, to allow expansion and contraction in the axial direction. The outer conductor 50 also telescopes in the outer conductor 52 with a sliding contact assembly 64, shown in FIG. 8, to allow expansion and contraction in the axial direction.

If a relative differential expansion is occurring between the segments along the length of the coaxial lines, the difference in expansion will be taken up by expansion or contraction of the expandable assembly 40.

As shown in FIG. 6, the sliding contact assembly 62 permits the inner conductor section 58 and inner conductor section 60 of the coaxial line to move slidably relative to one another at the same time as the outer conductor portions 50, 52 of the expandable element 40 also more slidably. Referring now to FIG. 7, a detail view of the sliding contact assembly 62 is illustrated. A pair of o-rings 66 and a spring contact 68 are provided to better ensure contact between the inner conductors 58, 60. The o-rings 66 seal the contact 68 from dirt and resistance that would interfere with conduction.

Figure 8:
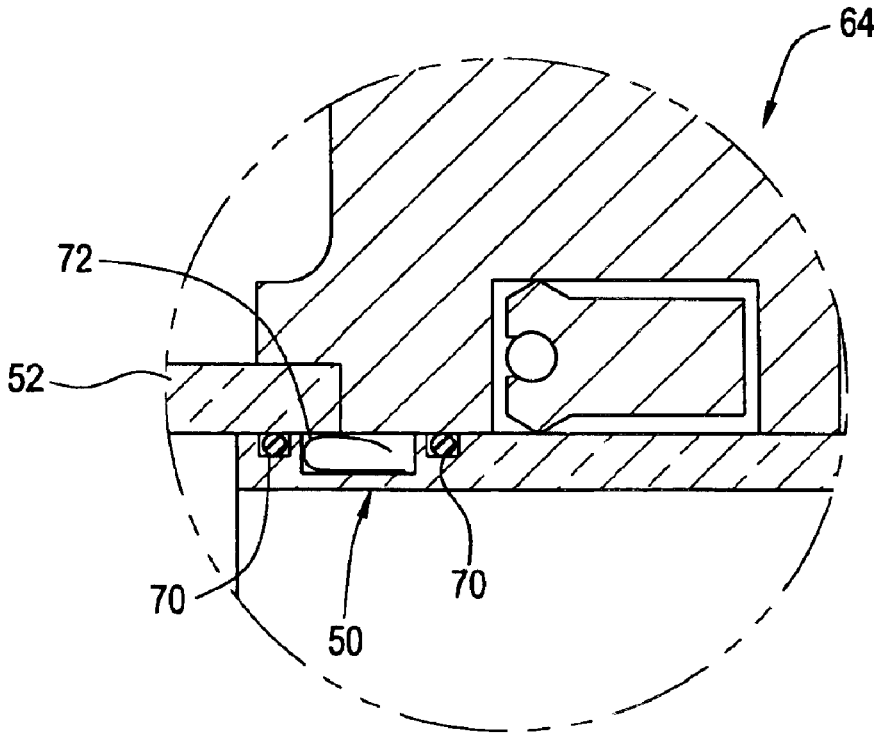
FIG. 8 is a detail view of an area of FIG. 6 so labeled.

Similarly, as shown in FIG. 6, the sliding contact assembly 64 permits the conductors 50 and 52 to move slidably relative to one another as the expandable element 40 expands or contracts. FIG. 8 provides a detail view of sliding contact 64. A pair of o-rings 70 and a spring contact 72 are provided to better ensure contact between the conductors 50 and 52. The o-rings 70 seal the contact 72 from dirt and resistance that would interfere with conduction.

As further shown in FIG. 6, the expandable assembly 40 has at one end an outer mounting ring 74. The mounting ring 74 supports an insulating spacer 76 which surrounds and locates the inner conductor 60. The ring 74 provides for connection to the adjacent coaxial component 42. When the expandable assembly 40 is oriented vertically, the ring 74 is preferably at the top of the assembly 40.

The expandable assembly 40 also includes at its other end (which is preferably the lower end in vertical orientation) a mounting ring 78 that provides for attachment to neighboring coaxial component. The ring 78 is attached to a support ring 80 as shown. Together with supporting ring 80, the ring 78 supports an insulating spacer 82, which supports and locates the internal conductor 58.

In order to provide overall stability to the expandable element 40 as it expands and contracts, additional support rings 84 and 86 are provided as shown. Periodically around the periphery of the assembly 40, guide rods 88 are provided. The guide rods are preferably each fixed at one of their ends to the support ring 80 and extend longitudinally along the expandable assembly 40. Each guide rod 88 is affixed through a bore 90 in the ring 80, and extends through a bushing 92 in the ring 84 and a bushing 94 in the ring 86. At its other end, the guide rod 88 has a stop plate 96 affixed thereto. In the position illustrated in FIG. 6, the assembly is shown in a fully expanded position, with the stop 96 abutting the ring 86 and preventing any further elongation of the expandable assembly 40. When the assembly contracts compared to this position, the rod 88 and stop 96 move towards the position shown in phantom lines in FIG. 6. In the preferred embodiment, four guide rods 88 disposed at even intervals around the periphery of the assembly 40 are used.

Although the example described uses one expandable element and one frame, in some examples it is possible to use more than one expandable element and/or more than one frame along either length of a line.

The many features and advantages of the invention are apparent from the detailed specification, and thus, it is intended by the appended claims to cover all such features and advantages of the invention which fall within the true spirits and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A method for connecting two coaxial line components to each other, each having a respective inner conductor and outer conductor, the method comprising:

permitting telescoping motion between a pair of telescoping inner conductor segments;

permitting telescoping motion between a pair of telescoping outer conductor segments; and supporting the respective inner and outer conductor segments in substantially parallel longitudinal alignment with each other, wherein a first support ring is rigidly attached to a first one of the outer conductors, and a second support ring is rigidly attached to a second one of the telescoping outer conductor segments; and at least one guide rod is rigidly attached to the first one of the support rings and slidably mounted through the second one of the support rings to maintain alignment of the telescoping inner and outer conductor segments.

2. An apparatus for connecting two coaxial line components to each other, each having a respective inner conductor and outer conductor, the apparatus comprising:

a pair of telescoping inner conductor segments;

a pair of telescoping outer conductor segments;

a support that supports the respective inner and outer conductor segments in substantially parallel longitudinal alignment with each other; and a first conductive spring member disposed between the telescoping inner conductor segments.

3. The apparatus according to claim 2, further comprising a second conductive spring member disposed between the telescoping outer conductor segments.

4. An apparatus according to claim 3, wherein the first conductive spring member is disposed between the telescoping inner conductor segments in an inner conductor groove provided in one of the pair of telescoping inner conductor segments, and a first pair of o-rings is provided on respective sides of the first conductive spring member.

5. An apparatus according to claim 4, wherein the second conductive spring member is disposed between the telescoping outer conductor segments in an outer conductor groove provided in one of the pair of telescoping outer conductor segments, and a second pair of o-rings is provided on respective sides of the second conductive spring member.

6. An apparatus for connecting two coaxial line components to each other, each having a respective inner conductor and outer conductor, the apparatus comprising:

a pair of telescoping inner conductor segments;

a pair of telescoping outer conductor segments;

a support that supports the respective inner and outer conductor segments in substantially parallel longitudinal alignment with each other;

a first support ring rigidly attached to a first one of the telescoping outer conductor segments, and a second support ring rigidly attached to a second one of the telescoping outer conductor segments; and at least one guide rod rigidly attached to the first one of the support rings and slidably mounted through the second one of the support rings to maintain telescoping alignment of the telescoping inner and outer conductor segments.

7. An apparatus according to claim 6, further comprising:

a stop member on the at least one guide rod that limits travel of the at least one guide rod relative to the second one of the support rings.

8. A method for connecting two coaxial line components to each other, each having a respective inner conductor and outer conductor, the method comprising:

permitting telescoping motion between a pair of telescoping inner conductor segments;

permitting telescoping motion between a pair of telescoping outer conductor segments; and supporting the respective inner and outer conductor segments in substantially parallel longitudinal alignment with each other, wherein the telescoping inner conductor segments have a first contact spring disposed between the telescoping inner conductor segments in a groove provided in one of the telescoping inner conductor segments, and a first pair of o-rings provided on respective sides of the first contact spring.

9. A method according to claim 8, wherein the telescoping outer conductor segments have a second contact spring disposed between the telescoping outer conductor segments in a groove provided in one of the telescoping outer conductor segments, and a second pair of o-rings provided on respective sides of the second contact spring.

10. An apparatus for connecting two collinear coaxial line components to each other, each having a respective inner conductor and outer conductor, the apparatus comprising:

expandable inner conducting means for conducting energy, wherein the expandable inner conducting means comprises telescoping inner conductor segments, wherein the energy conducted is a first polarity of an electrical signal;

expandable outer conducting means for conducting energy, wherein the energy conducted is a second polarity of an electrical signal, opposite to the first polarity of the electrical signal;

supporting means for supporting the inner and outer conducting means in substantial parallel longitudinal alignment with each other; and spring contacting means disposed between the inner conducting means in a groove provided in a first one of the telescoping inner conducting means, and a pair of o-rings provided on respective sides of the spring contacting means.

11. An apparatus for connecting two collinear coaxial line components to each other, each having a respective inner conductor and outer conductor, the apparatus comprising:

expandable inner conducting means for conducting energy, wherein the energy conducted is a first polarity of an electrical signal;

expandable outer conducting means for conducting energy, wherein the energy conducted is a second polarity of an electrical signal, opposite to the first polarity of the electrical signal; and supporting means for supporting the inner and outer conducting means in substantial parallel longitudinal alignment with each other, wherein the supporting means comprises a first ring rigidly attached to a first end of a first one of the telescoping outer conducting means, a second ring rigidly attached to an end of a second one of the telescoping outer conducting means distal to the first end of the first telescoping outer conducting means, and at least one guide rod rigidly attached to one of the support rings and slidably mounted through the other support ring to maintain alignment of the telescoping inner and outer conducting means.

12. An apparatus according to claim 11, further comprising means for limiting travel of the guide rod.

13. An apparatus for connecting two collinear coaxial line components to each other, each having a respective inner conductor and outer conductor, the apparatus comprising:

expandable inner conducting means for conducting energy, wherein the energy conducted is a first polarity of an electrical signal;

expandable outer conducting means for conducting energy, wherein the expandable outer conducting means comprises telescoping outer conductor segments, wherein the energy conducted is a second polarity of an electrical signal, opposite to the first polarity of the electrical signal;

supporting means for supporting the inner and outer conducting means in substantial parallel longitudinal alignment with each other; and spring contacting means disposed between the outer conducting means in a groove provided in a first one of the telescoping outer conducting means, and a pair of o-rings provided on respective sides of the spring contacting means.

* * * * *